US012108887B2

(12) United States Patent
Lopez Uran

(10) Patent No.: US 12,108,887 B2
(45) Date of Patent: Oct. 8, 2024

(54) PALLET

(71) Applicant: CHEP Technology Pty Limited, Sydney (AU)

(72) Inventor: Daniel Lopez Uran, London (GB)

(73) Assignee: CHEP TECHNOLOGY PTY LIMITED, Sydney (AU)

( * ) Notice: Subject to any disclaimer, the term of this patent is extended or adjusted under 35 U.S.C. 154(b) by 141 days.

(21) Appl. No.: 17/757,575

(22) PCT Filed: Dec. 17, 2020

(86) PCT No.: PCT/IB2020/062105
§ 371 (c)(1),
(2) Date: Jun. 17, 2022

(87) PCT Pub. No.: WO2021/124196
PCT Pub. Date: Jun. 24, 2021

(65) Prior Publication Data

US 2023/0015902 A1 Jan. 19, 2023

(30) Foreign Application Priority Data

Dec. 20, 2019 (GB) ..... 1918953

(51) Int. Cl.
*A47F 3/14* (2006.01)
*A47F 5/10* (2006.01)
(Continued)

(52) U.S. Cl.
CPC ..... *A47F 3/142* (2013.01); *A47F 5/10* (2013.01); *B65D 19/001* (2013.01); *B65D 19/44* (2013.01);
(Continued)

(58) Field of Classification Search
CPC . A47F 3/142; A47F 5/10; B65D 1519/00771; B65D 1519/00746;
(Continued)

(56) References Cited

U.S. PATENT DOCUMENTS 6,024,223 A * 2/2000 Ritter ..... B65D 19/18 206/386
6,109,190 A * 8/2000 Hale ..... B65D 19/0016 108/57.25
(Continued)

FOREIGN PATENT DOCUMENTS

DE 9016619 U1 2/1991
DE 2106619 A1 8/1991
(Continued)

OTHER PUBLICATIONS

Examination Report for Great Britain Patent Application No. GB1918953.9, dated Apr. 12, 2023, (4 pages), Intellectual Property Office, South Wales, Great Britain.
(Continued)

*Primary Examiner* — Daniel J Rohrhoff
(74) *Attorney, Agent, or Firm* — Alston & Bird LLP

(57) ABSTRACT

A platform comprising a deck, wherein the deck comprises a product supporting surface for supporting an article thereon. The deck is defined by a plurality of sidewalls which extend from a periphery of the product supporting surface. The platform further comprises an attachment feature arrangement disposed along one or more of the sidewalls. The attachment feature arrangement comprises an inner slot and an outer recess. The inner slot and the outer recess are disposed adjacent one another and separated by a divider. The inner slot comprises one or more inwardly-facing projections, and the outer recess comprises one or more outwardly-facing projections. The projections extend from the divider and are configured to engage a correspond-
(Continued)

ing projection-engaging feature of the article supported by the product supporting surface.

16 Claims, 5 Drawing Sheets

(51) Int. Cl.
*B65D 19/00* (2006.01)
*B65D 19/44* (2006.01)

(52) U.S. Cl.
CPC ..... *B65D 2519/00343* (2013.01); *B65D 2519/00995* (2013.01); *B65D 2571/00067* (2013.01)

(58) Field of Classification Search
CPC ..... B65D 1519/009; B65D 1519/0098; B65D 19/38; B65D 19/385; B65D 19/44
See application file for complete search history.

(56) References Cited

U.S. PATENT DOCUMENTS

| | | | | |
|---|---|---|---|---|
| 8,191,489 | B1 * | 6/2012 | Smith | A47F 3/142 108/193 |
| 9,370,241 | B1 * | 6/2016 | Dilmaghani | A47B 13/08 |
| 9,487,329 | B2 * | 11/2016 | Balazs | B65D 19/04 |
| 9,637,266 | B2 * | 5/2017 | Itano | B65D 5/5035 |
| 2010/0213088 | A1 * | 8/2010 | Goda | B65D 19/06 206/386 |
| 2011/0048990 | A1 * | 3/2011 | Goda | B65D 81/053 206/521 |
| 2015/0135999 | A1 * | 5/2015 | Takyar | B65D 19/06 108/53.3 |
| 2016/0198870 | A1 * | 7/2016 | Volz | A47F 5/116 211/135 |
| 2019/0055055 | A1 | 2/2019 | Wood et al. | |
| 2019/0055057 | A1 * | 2/2019 | Wood | B65D 19/0026 |
| 2019/0059583 | A1 * | 2/2019 | Sullivan | A47F 5/10 |

FOREIGN PATENT DOCUMENTS

| | | |
|---|---|---|
| DE | 29713315 U | 11/1997 |
| DE | 202014102900 | 10/2015 |
| NZ | 286811 | 10/1997 |
| WO | WO2011060794 | 5/2011 |
| WO | WO-2019/036431 A1 | 8/2018 |
| WO | WO2019166692 | 9/2019 |
| WO | WO 2021/124196 A1 | 6/2021 |

OTHER PUBLICATIONS

Examination Report for Great Britain Patent Application No. GB1918953.9, dated Dec. 22, 2023, (4 pages), Intellectual Property Office, South Wales, Great Britain.

International Search Report and Written Opinion for International Application No. PCT/IB2020/062105, dated Mar. 26, 2021, (20 pages), Australian Patent Office, Woden ACT, Australia.

Chilean Office Action for Chilean Application No. 202201648, dated May 17, 2024, 28 pages.

* cited by examiner

PALLET

The present invention relates to a platform, a pallet, a pallet display assembly and a quarter size display.

Pallets for distributing products from one location to another, and for use as display-at-the-store pallets, are well known. Such pallets can be provided in a range of sizes such as, for example, full size pallets, half size pallets and quarter pallets. Examples of such pallets may comprise platforms with pallet supports, which can include feet, skids and wheels. Wheels may be incorporated in dollies, which may otherwise be referred to as wheeled pallets.

It is desirable to be able to incorporate various features into pallets. However, in order to effectively incorporate such features, modifications to existing pallet designs may be required.

There exists a need to overcome one or more of the disadvantages associated with existing pallets.

According to a first aspect of the invention there is provided a platform comprising a deck, the deck comprising a product supporting surface for supporting an article thereon, the deck being defined by a plurality of sidewalls which extend from a periphery of the product supporting surface, wherein the platform further comprises an attachment feature arrangement disposed along one or more of the sidewalls, the attachment feature arrangement comprising an inner slot and an outer recess, the inner slot and the outer recess being disposed adjacent one another and separated by a divider; wherein the inner slot comprises one or more inwardly-facing projections, and the outer recess comprises one or more outwardly-facing projections; and wherein the projections extend from the divider and are configured to engage a corresponding projection-engaging feature of the article supported by the product supporting surface.

The inner slot and outer recess being adjacent one another may otherwise be described as the inner slot and outer recess directly opposing one another. That is to say, the inner slot and outer recess may be aligned with a line perpendicular to an edge of the product supporting surface. Each sidewall may be said to extend in a longitudinal direction. Adjacent one another is intended to mean the same longitudinal position relative to, or along, the sidewall.

The inner slot and outer recess may be said to be recessed into the product supporting surface.

The attachment feature arrangement may be said to be disposed along, or aligned with, the sidewalls.

The inner slot and outer recess being separated by the divider may otherwise be described as the inner slot and outer recess being defined, at least in part, by the divider.

The divider may comprise a wall. The divider may be described as rib-like. The divider may have a substantially uniform thickness. A top surface of the divider may define, at least in part, the product supporting surface. That is to say, at least a portion of the top surface of the divider may lie in the same plane as the product supporting surface.

An inward direction refers to a direction moving from a sidewall towards a central point of the product supporting surface (i.e. towards a centre of the product supporting surface, across the product supporting surface). Outward refers to a direction moving from the central point of the product supporting surface towards the sidewall (i.e. away from a centre of the product supporting surface, across the product supporting surface).

At least a portion of the projections may protrude perpendicularly from the divider.

The projection-engaging feature may be tab with a hole, or aperture, disposed therein. The projection-engaging feature may be a connecting flap. The projection-engaging feature may otherwise be described as a securing means.

An advantage provided by locating both the inner slot and outer recess adjacent one another is that articles to be supported by the product supporting surface can be configured to use either the inner slot or outer recess as an attachment means. This provides more flexibility in design freedom, in comparison to other arrangements which do not incorporate such aligned features. For example, where a display is to be connected to the platform using the inwardly-facing projection, which engages a tab, the tab can be hidden from view. This is owing to the tab being offset from an edge of the base of the display, and thereby being concealed by the base in use. However, this may be counteracted by the fact that the tab must be inserted more precisely into the inner slot (owing to the offset nature of both the tab and the inner slot). In contrast, where a display is to be connected using the outwardly-facing projection, which engages a tab, the insertion can be more swift and doesn't require the level of precision that the inwardly-facing projection connection does. The outwardly-facing projection can therefore be used in an automatic or semi-automatic insertion process, but the tab may remain visible, or exposed, in use. In short, both alternatives provide their own advantages, and having both aligned with one another enables a designer to utilise whichever connection is best suited for the display, or article more generally, in question.

The attachment feature arrangement may be disposed at a midpoint of the sidewall.

The platform may comprise a plurality of attachment feature arrangements, at least one attachment feature arrangement being disposed along each of four sidewalls of the deck.

The attachment feature arrangements may be substantially identical attachment feature arrangements. The deck may be generally rectangular.

The deck may be generally rectangular such that two sidewalls are short sidewalls and two sidewalls are long sidewalls.

A plurality of attachment feature arrangements may be disposed along each of the two long sidewalls, and an attachment feature arrangement may be disposed along each of the two short sidewalls.

The attachment feature arrangement disposed along each of the two short sidewalls may be disposed at a midpoint of each of the two short sidewalls.

The plurality of attachment feature arrangements may be disposed along each of the two long sidewalls and may comprise two attachment feature arrangements, and wherein the two attachment feature arrangements may be provided at positions around 25% and around 75% of a length of the long sidewalls respectively.

The attachment feature arrangements being provided at positions around 25% and around 75% of a length of the long sidewalls is intended to mean that if the extent of the long sidewall was split in two, forming two even sections, the attachment feature arrangements would be disposed at a midpoint of each of the two sections. Put another way, if the length of the long sidewall was divided into four portions, the attachment feature arrangements would be provided at an intersection between the first and second, and third and fourth, portions.

Advantageously, where the platform is a half pallet platform, providing the attachment feature arrangements as specified allows two quarter pallet displays to be connected to the half pallet. This is owing to the fact that at least three attachment feature arrangements are provided, at each end of the platform, in similar positions to that of a quarter pallet. That is to say, a footprint defined by the attachment feature arrangement is generally similar to a footprint defined by two adjacent quarter pallets. Put another way, the distribution of attachment feature arrangements on the half pallet platform generally map to the distribution of attachment points on a quarter pallet.

The divider may comprise a wall with a recess.

The recess may be generally trapezoidal. That is to say, an upper width of the recess may be greater than a lower width of the recess.

The recess may define a gap between the product supporting surface and the divider. That is to say, the recess may reduce the height of the wall, relative to the product supporting surface, across at least a portion of the wall. The recess may be said to be provided in an upper portion of the wall. The recess may be said to be provided in an upper central portion of the wall.

The recess may define a plurality of portions of the wall which lie in a plane of the product supporting surface.

The plurality of portions may be two portions. The portions of the wall lying in the plane of the product supporting surface may otherwise be expressed as the portions defining, at least in part, the product supporting surface.

Advantageously, the recess can be incorporated without significantly reducing the support provided by the product supporting surface. That is to say, because the portions lie in the plane of the product supporting surface, any articles disposed on the product supporting surface are also supported by the portions. The portions therefore provide support, for the article, in a region in which the article would otherwise be unsupported (owing to a lack of product supporting surface in the region).

The platform may be a half pallet platform.

Half pallet platform refers to a platform which forms part of a half pallet. The half pallet platform may have dimensions 800 mm×600 mm (excluding a thickness of the platform).

According to a second aspect of the invention there is provided a pallet comprising:

the platform according to the first aspect of the invention; and one or more pallet supports connected to the platform.

Examples of pallet supports include feet, wheels and skids.

The one or pallet supports may be separate components such that the pallet is modular. Alternatively, the pallet supports may be integrally formed with the platform.

The pallet may comprise the platform and three skids connected to the platform. The skids may extend in a direction along a short side of the platform.

The pallet may be a quarter pallet.

The quarter pallet may be an AU, EU or US quarter pallet. Where the pallet is a quarter pallet, all of the attachment feature arrangements may be disposed along midpoints of the sidewalls. An attachment feature arrangement may be disposed along a midpoint of each sidewall.

The pallet may be a sixth pallet.

Sixth pallet refers to a pallet having dimensions ⅙ of a standard, full-size pallet. The sixth pallet may be an AU sixth pallet.

According to a third aspect of the invention there is provided a pallet display assembly comprising:

a half pallet comprising a deck, the deck comprising a product supporting surface; and two quarter size displays connected to the deck.

Quarter size displays is intended to mean displays designed for use with a quarter pallet i.e. quarter pallet displays. For example, the quarter size displays may be intended for use with a quarter pallet having a footprint of 400 mm×600 mm.

The half pallet may be an EU half pallet. That is to say, the deck may be 800 mm×600 mm.

The use of two quarter pallet displays on the product supporting surface of a half pallet advantageously means that two displays can be used on a single pallet. This can allow, for example, twice the amount of goods and products, disposed on the displays, to be moved around, stored and displayed using the half pallet. Furthermore, this particular sized assembly is beneficial because the quarter pallet platform is a popular platform in retail environments, which means there are many existing display designs available. The use of a half pallet in the claimed manner, i.e. to support two quarter pallet displays, therefore allows a half pallet to be used with existing quarter pallet displays. This may be particularly desirable in larger retail environments where, for example, it is desirable to have multiple quarter pallet displays adjacent one another. Whereas previously this would require the use of two quarter pallets, this can now be achieved using a single half pallet. There are associated improvements in efficiency owing to the fact that the single half pallet can serve the purpose of two individual quarter pallets.

The two quarter size displays may be said to directly engage the half pallet. The two quarter size displays may be said to engage attachment feature arrangements of the half pallet, and specifically attachment feature arrangements of the deck. Projection-engaging features of the quarter size displays may be said to engage attachment feature arrangements of the half pallet. The two quarter size displays may be said to be connected to the product supporting surface.

The deck may be said to define the product supporting surface.

The half pallet may comprise the half pallet platform according to the first aspect of the invention.

The half pallet may comprise one or more attachment feature arrangements, and the quarter size displays may comprise one or more projection-engaging features, and the one or more projection-engaging features may engage a respective projection of the one or more attachment feature arrangements.

The projection may be inwardly-facing, or outwardly-facing. Each attachment feature arrangement may be engaged by a respective projection-engaging feature.

According to a fourth aspect of the invention there is provided a quarter size display for a pallet, the quarter size display comprising:

a structure for supporting products thereon, the structure comprising a base configured to engage a product supporting surface of the pallet; and a plurality of projection-engaging features which extend from the base, configured to engage corresponding outwardly-facing projections of the pallet, and wherein the plurality of projection-engaging features are disposed along midpoints of at least three sides of the base.

The base may be rectangular. The base may have approximate dimensions 400 mm×600 mm.

Products may otherwise be described as goods. Products may otherwise be referred to as items displayed on the display.

Where the projection-engaging feature is a tab of some variety, an aperture which is generally square or rectangular may be incorporated. That is to say, the aperture may be, or comprise, a geometry which generally has two pairs of parallel sides. Such aperture geometries have been found to be particularly effective when used with outwardly-facing projections.

The two quarter size displays may comprise the quarter size display according to the fourth aspect of the invention.

Both of the quarter size displays may be in accordance with the fourth aspect of the invention.

Embodiments of the present invention will now be described, by way of example only, with reference to the accompanying Figures in which:

FIG. 1*a* is a perspective view of a half pallet according to an embodiment of the invention;

FIG. 1*b* is a close-up perspective view of an attachment feature arrangement of the half pallet of FIG. 1*a;*

FIG. 1*c* is a close-up plan view of the attachment feature arrangement shown in FIG. 1*b;*

FIG. 1*d* is a close-up perspective cutaway view of the attachment feature arrangement shown in FIG. 1*b;*

Figure 4A:
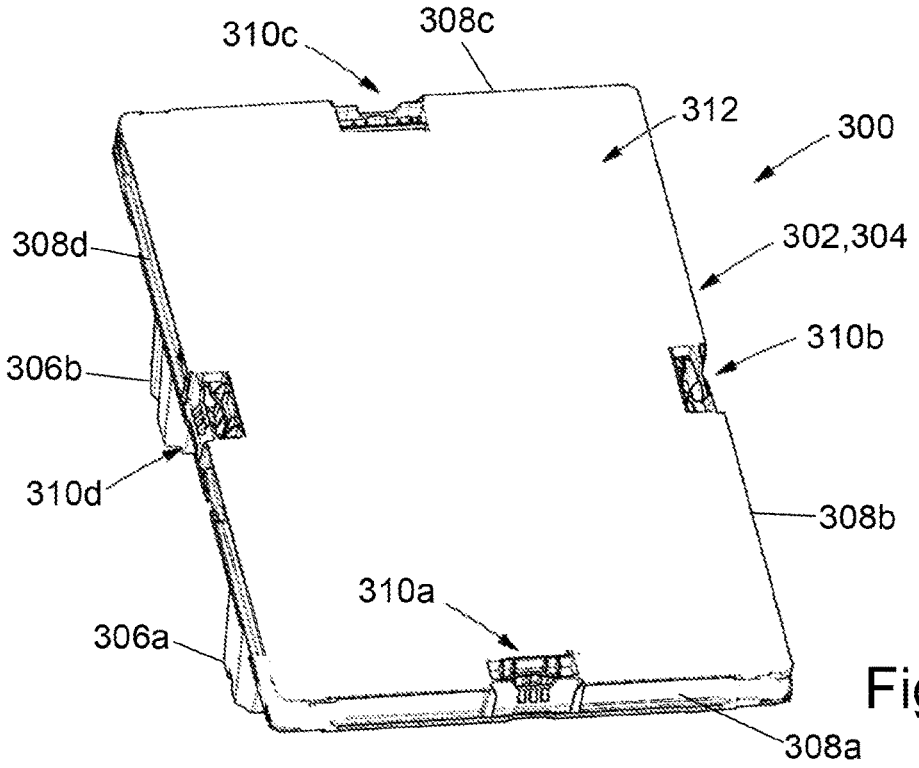
Figure 4B:
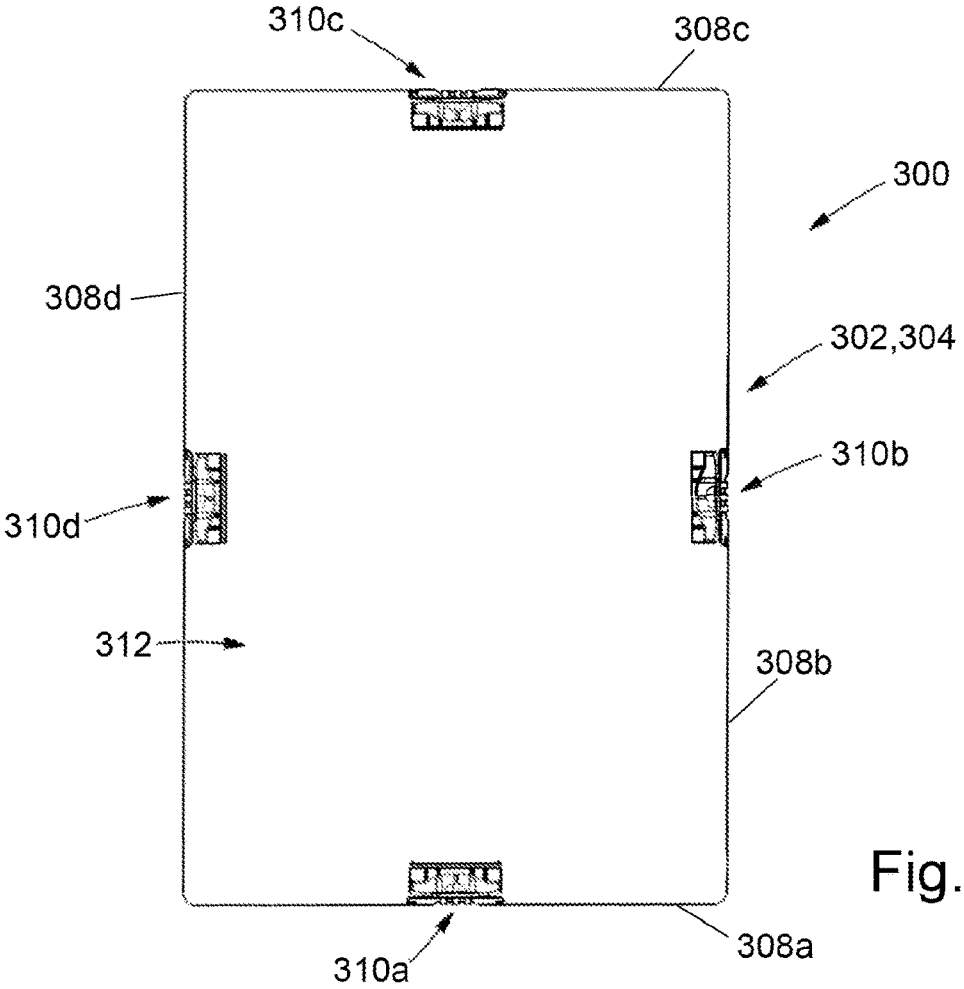

FIG. 4*a* is a perspective view of a quarter pallet according to an embodiment of the invention; and FIG. 4*b* is a plan view of the quarter pallet shown in FIG. 4*a*.

The present application relates to three primary concepts. A first concept relates to that of a novel design of platform incorporating an attachment feature arrangement at one or more sidewalls thereof. The second concept relates to a pallet display assembly in which two quarter size displays are incorporated on a single half pallet. The third concept relates to a quarter size display.

Figure 1A:
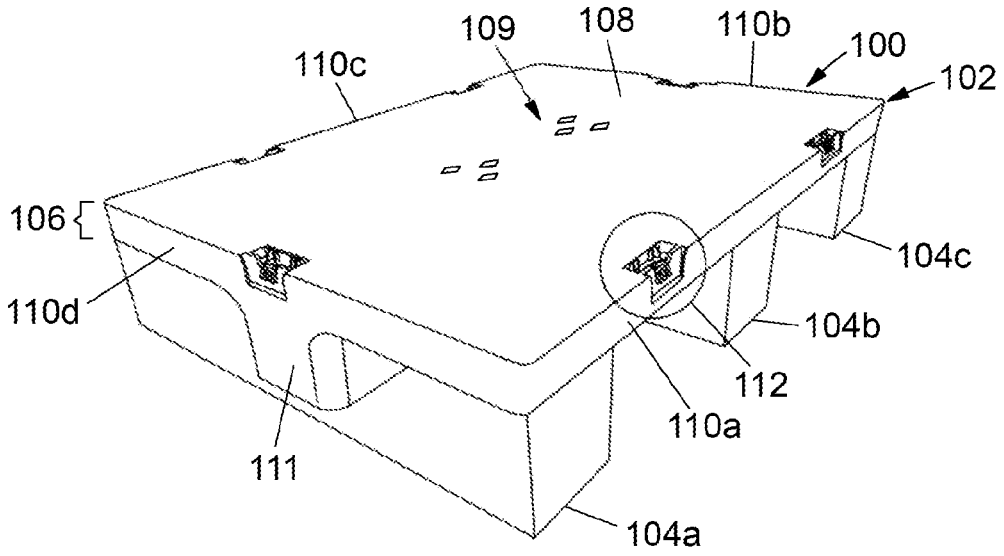

FIG. 1*a* is a perspective view of a pallet 100 according to an embodiment of the invention.

The pallet 100 comprises a platform 102 and three skids 104*a-c*. In other embodiments, the pallet may be formed of a single, homogenous body (i.e. a quarter pallet).

The platform 102 comprises a deck 106, the thickness of which is indicated in FIG. 1*a*. The deck 106 comprises a product supporting surface 108. Product supporting surface 108 is for supporting an article thereon. Examples of articles include goods, products and displays, or a combination thereof. The product supporting surface 108 further comprises an array of diamond cut-outs 109. The array can be used to provide drainage, be used for branding purposes, and may also be used in the attachment of articles, such as displays, to the deck 106. This will be described in more detail below.

The platform 102 further comprises a plurality of blocks 111 (only one of which is visible in FIG. 1*a*). The blocks 111 may interpose the deck 106 and the skids 104*a-c*. The blocks 111 may be integrally formed with the deck 106.

The deck 106 is defined by a plurality of sidewalls 110*a-d*. The sidewalls 110*a-d* extend from a periphery (e.g. outer edge) of the product supporting surface 108.

The pallet 100 shown in FIG. 1*a* is a half pallet. The deck 106 is also, in the illustrated embodiment, generally rectangular. As such, the deck 106 comprises two short sides and two long sides. The short sides correspond with the sidewalls 110*b*, 101*d*, whilst the long sides correspond with sidewalls 110*a* and 110*c*. As will be appreciated from FIG. 1*a*, the deck 106 incorporates a number of different features for drainage and for adapting the pallet 100 for a variety of specific uses. Two such uses include the use of the pallet 100 as a display pallet (i.e. with displays supported by the product supporting surface 108) and as a slave pallet (i.e. with other pallets stacked on the product supporting surface 108).

Figure 1B:
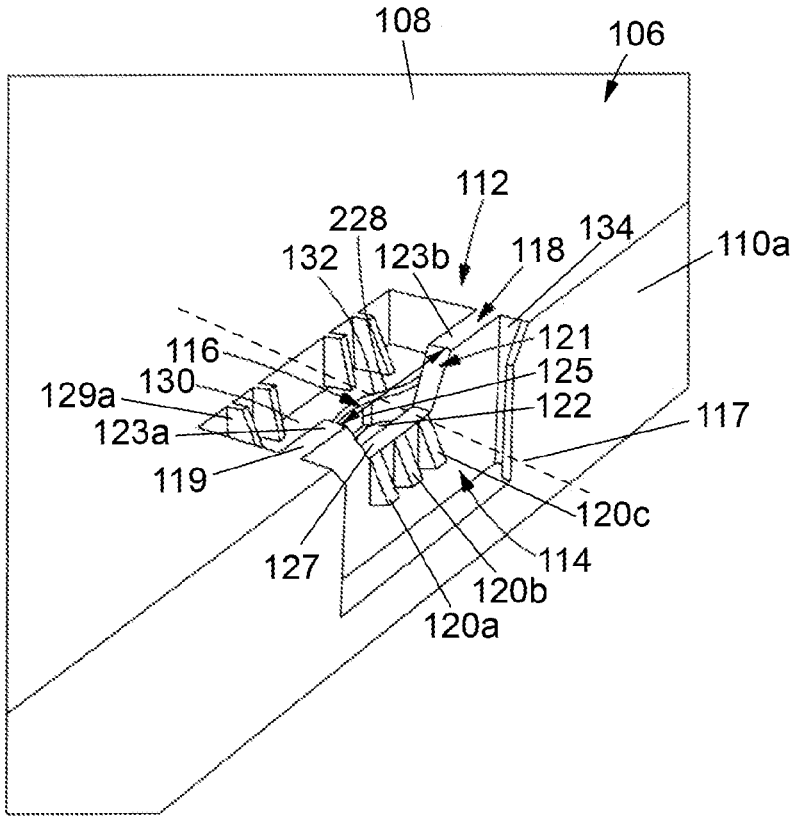

The features of particular interest for the purpose of this concept are various attachment features, specifically attachment feature arrangements, disposed along the sidewalls 110*a-d*. One such attachment feature arrangement is the circled arrangement numbered 112 in FIG. 1*a*. FIG. 1*b* is a magnified view of the attachment feature arrangement 112 as shown in FIG. 1*a*.

Turning to FIG. 1*b*, the attachment feature arrangement 112 comprises two primary features. A first is an outer recess 114. A second is an inner slot 116. The inner slot 116 and outer recess 114 are so called due to their proximity to the sidewall 110*a* of the deck 106. Specifically, the outer recess 114 is referred to as the outer feature because it is closer to the sidewall 110*a* than the inner slot 116.

The inner slot 116 and outer recess 114 are adjacent one another in that they directly oppose one another. That is to say, the inner slot 116 and outer recess 114 are aligned with a line perpendicular to an edge of the product supporting surface 108. An example of such a line is shown in FIG. 1*b*, across the product supporting surface 108, labeled 117. Furthermore, the inner slot 116 and outer recess 114 are separated by a divider 118. The divider 118 can be described as a wall, a rib, or a web, which extends at least partly across the product supporting surface 108. In some embodiments, at least a portion of the divider 118 may lie in the plane of the product supporting surface 108. That is to say, the divider 118 may define, at least in part, the product supporting surface 108. The inner slot 116 and outer recess 114 can also be said to be defined, at least in part, by the divider 118. The inner slot 116 and outer recess 114 may be said to directly oppose one another about the divider 118.

The outer recess 114 comprises one or more projections 120*a-c*. In the illustrated arrangement, the outer recess 114 comprises three wedge-shaped projections 120*a-c*. The wedge-shaped projections are so called because they are generally triangular, and the extent to which they project increases in a direction moving along the product supporting surface 108 and away from a centre of the product supporting surface 108. The projections 120*a-c* are outwardly-facing projections. That is to say, the projections 120*a-c* project away from a central point on the product supporting surface 108. The three wedge-shaped projections 120*a-c* are configured to engage a corresponding projection-engaging feature of an article, such as a display, supported by the product supporting surface 108. In other words, the projections 120*a-c* can be used to grip, engage or secure an article supported on the product supporting surface 108. Said projection engaging feature of the article may be a tab with a hole in it, to name one example, or a connecting flap. The projections 120*a-c* can therefore ensure that the projection-engaging feature remains retained, and secured, within the outer recess 114. It therefore follows that the article, of which the projection-engaging feature(s) forms part, is also secured on, or relative to, the product supporting surface 108 as a result. Where the projection-engaging feature is a tab of some variety, an aperture which is generally square or rectangular may be incorporated. That is to say, the aperture may be, or comprise, a geometry which generally has two pairs of parallel sides. Such aperture geometries have been found to be particularly effective when used with outwardly-facing projections as described above.

Whilst three projections 120*a-c* are illustrated, other numbers of projections may otherwise be used. For example, more, or fewer, projections may alternatively be incorporated. All of the projections 120*a-c* may engage a single hole, or aperture, for example, forming part of the projection-engaging feature. Alternatively, each projection 120*a-c* may engage a respective hole or aperture.

Like the outer recess 114, the inner slot 116 comprises a projection 122 which extends from the divider 118. However, the projection 122 is inwardly-projecting (i.e. towards a centre point of the product supporting surface 108). In this instance the projection 122 is a tongue and, more preferably, an at least partly-spherical tongue. Again, the projection 122 is configured to engage a projection-engaging feature of an article, such as a display, supported by the product supporting surface 108. Where the projection-engaging feature is a tab of some variety, an aperture which is at least partly arcuate may be incorporated. The aperture may be described as part-spherical, or hemispherical. An at least partly arcuate aperture has been found to be advantageous when used with inwardly-facing projections as described above. The inner slot 116 may be said to be generally rectangular, optionally including an arcuate side, and recessed beneath the product supporting surface 108. More detail regarding the inner slot 116 is provided below.

As mentioned above, the divider 118 can be said to at least partly define the inner slot 116 and outer recess 114. Furthermore, the divider 118, in the illustrated arrangement, comprises a wall 119 which comprises a recess 121. The wall 119 has a uniform thickness, and the projections 120*a-c*, 122 extend from the wall 119. The recess 121 is generally trapezoidal, defining two portions 123*a*, 123*b* of the wall 119 which lie in the plane of the product supporting surface 108. The two portions 123*a*, 123*b* are interposed by an upper width of the recess 121, indicated generally by arrow 125. A lower width of the recess is labeled 127. The lower and upper widths of the recess 121 can be considered akin to the parallel sides of a trapezium.

The presence of the portions 123*a*, 123*b* is advantageous because greater support is provided to any articles disposed on the product supporting surface 108. Specifically, in the absence of these portions 123*a*, 123*b*, there would be a larger cavity between the inner slot 116 and outer recess 114 in which the article would not be supported by the product supporting surface 108. Put another way, it is advantageous to remove as little of the product supporting surface 108 as possible, such that article support is not detrimentally affected. Providing the recess 117, which defines the portions 123*a*, 123*b* which lie in the plane of the product supporting surface 108, allows this to be achieved. A lack of support by the product supporting surface 108 could otherwise result in damage, or undue deformation, to the article.

The attachment feature arrangement 112 can allow POS (point of sale) displays, usually made of cardboard, to be attached to the pallet 100. The POS displays may be pre-filled with goods or products, such that the loaded pallet can be placed on the shop floor without the need to manually replenish shelves (for example). The attachment feature 112 also provides a convenient and user-friendly way of dismantling a pallet display assembly by removing the display from the pallet when no longer required.

An advantage provided by locating both the inner slot 116 and outer recess 114 adjacent one another is that articles to be supported by the product supporting surface 108 can be configured to use either the inner slot 116 or outer recess 114 as an attachment means. This provides more flexibility in design freedom, in comparison to other arrangements which do not incorporate such aligned features. An additional benefit of this arrangement is that the connectivity options, such as tabs, for attaching POS displays can be located in positions which provide the best protection for the POS display. In other words, the risk of damage to the POS display may be reduced.

Using the inner slot 116 or outer recess 114 can provide different aesthetic and functional benefits as desired by a designer and/or as required by a display environment. For example, if the designer wishes for the projection-engaging feature, such as a tab, to be concealed, the designer can utilise the inner slot 116 (i.e. design the tab such that it is received by the inner slot 116). If the designer wishes for the projection-engaging feature to be easily accessible, the outer recess 114 may instead be utilised.

The inner slot 116 and outer recess 114 may provide attachments, or connections, to projection-engaging features with similar efficiency and resistance to one another. That is to say, the inner slot 116 and outer recess 114 may provide similar performance in use, but differ from one another by virtue of aesthetics and/or ergonomics.

In the illustrated example of FIG. 1*a*, there are six attachment feature arrangements 112 disposed along the sidewalls 110*a-d* of the deck 106. Specifically, two attachment feature arrangements 112 are disposed along each one of the long sides 110*a*, 110*c* whilst one is disposed along each of the shorter sides 110*b*, 110*d*. That is to say, at least one attachment feature arrangement 112 is disposed along each sidewall 110*a-d*. The arrangements 112 are disposed along an axis of symmetry along each of the short sides 110*b*, 110*d*, and are disposed equidistantly from a central skid 104*b* along the long sides 110*a*, 110*c*. This arrangement of attachment features therefore provides at least one axis of symmetry across the deck 106. The distribution, or position, of the arrangements 112 on the long sides 110*a*, 110*c* may otherwise be described as the arrangements being provided at around 25% and around 75% of the length of the long sides 110*a*, 110*c*.

Incorporating a plurality of attachment feature arrangements also allows POS displays to be secured on multiple sides (preferably all sides). This reduces the risk of the POS display becoming damaged during handling, storage and transportation. The combination of a pallet with a display attached thereto may be referred to as a retail ready solution (RRP). The use of multiple attachment feature arrangements can also allow the pallet to be used in a wider range of display applications in-store (such as replenishment and merchandising, to name two examples).

By providing six attachment feature arrangements as distributed in FIG. 1*a*, the attachment features are provided at positions which closely replicate that of a quarter pallet. Where the platform is a half pallet platform, the attachment feature arrangement distribution advantageously enables two quarter size displays to be directly connected to the half pallet platform. This will be described in more detail below.

Returning to FIG. 1*b*, the outer recess 114 may be described as a vertically arranged, inwardly recessed, slot. Each outer recess 114 has an open top for receiving a descending projection-engaging feature from an article to be supported by the product supporting surface 108. The outwardly-facing projections 120*a-c* may be a set of engagement teeth or members extending laterally across a short width of the slot, i.e. perpendicular to the respective sidewall

110*a-d* (and so outwardly relative to the product supporting surface). In FIG. 1*b* the wedge-shaped projections 120*a-c* are shown to have a tapered side (the face that projects outwardly) and a flat bottom (the face that faces away from the product supporting surface 108), and thus they resemble a saw-tooth in vertical plan, when seen parallel to the longitudinal length of the slot. In this example, there are three wedge-shaped projections 120*a-c*. However, fewer or more projections may be provided. Even a single projection can be provided.

Due to the recessed nature of the outer recess 114 relative to the sidewall 110*a*, a gap 134 is defined. The gap 134 can receive edges of a projection-engaging feature. The gap 134 allows the projection-engaging feature to locate and be gripped, or held, both laterally as well as longitudinally in the outer recess 114. The projections 120*a-c* then also hold the projection-engaging feature vertically, thus providing a reliable securement of the projection-engaging feature once inserted in the outer recess 114, but yet one that can easily have the projection-engaging feature removed if needed, e.g. through a sidewards ejection.

In place of the wedges of the wedge-shaped projections 120*a-c*, other shapes, including rounded members, may be provided. The flat bottom is also non-essential (for both inner slot 116 and outer recess 114), although flat bottoms (or a lowermost outward point) does assist with providing a positive location for gripping a projection-engaging feature, especially where that projection-engaging feature has a hole for receiving that tooth, member, element, point or projection. The tooth, member, element, point or projection may grip the descending projection-engaging feature, or engage in a hole thereof if such a hole is provided, to make the article more secure on the pallet.

The outer recess 114 may be recessed relative to the sidewall 110*a* by about 4 mm, thus accommodating a projection-engaging feature made from a sheet material (e.g. corrugated cardboard) having a thickness of up to 4 mm without crushing the corrugations in those edge portions. Thicker boards can also be accommodated, but they will be crushed as necessary. A wider width may be preferred for certain applications, although 4 mm is preferred for most applications.

A recessed shelf 130 is also shown in FIG. 1*b*. As suggested, the recessed shelf 130 is recessed relative to the product supporting surface 108. The recessed shelf 130 is supported by a plurality of ribs, one of which is labeled 129*a* in FIG. 1*b*. The recessed shelf defines, at least in part, the inner slot 116. More details regarding the recessed shelf 130 are provided in connection with FIG. 1*c*.

Figure 1C:
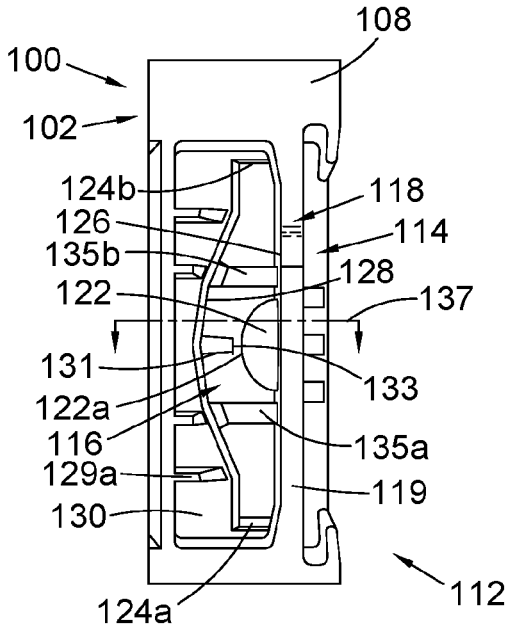

Turning to FIG. 1*c*, a plan view of the attachment feature arrangement 112 is illustrated. The opposed nature of the inner slot 116 and outer recess 114 is also indicated in FIG. 1*c*.

As shown in FIG. 1*c*, the inner slot 116 is defined by a set of surrounding walls 124*a*, 124*b*, a flat side 126 and a humped, or arcuate, side 128 when viewed in plan. It also has the projection 122 associated therewith for interacting with a projection-engaging feature when such feature is inserted into the inner slot 116.

Figure 1D:
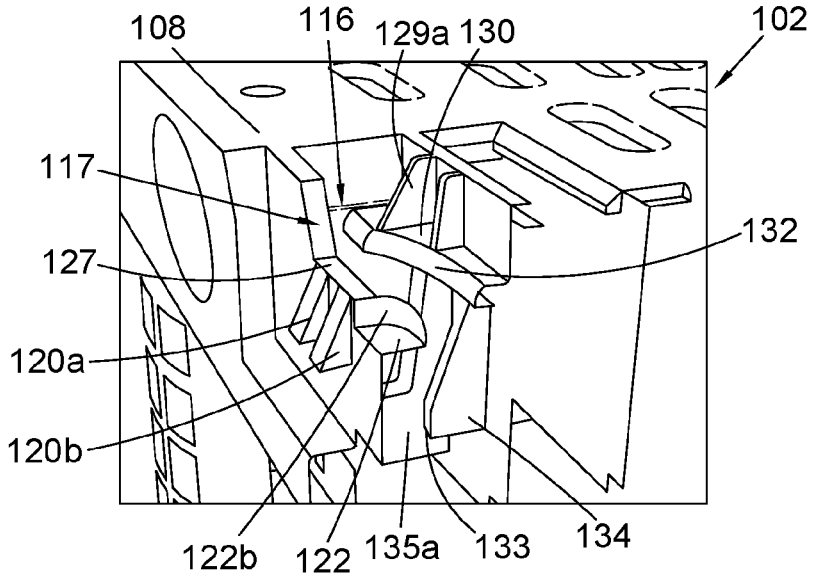

The projection 122 may be described as a recessed projection which takes the form of a rounded or part-spherical member. The projection 122 is arranged with a rounded surface pointing generally upwards (i.e. away from the skids) and has a flat bottom facing downwards (i.e. towards the skids). The projection 122 is inwardly facing. FIG. 1*d* shows the projection 122 from a cutaway perspective.

Returning to FIG. 1*c*, the inner slot 116 comprises a further member 131 which extends from an underside of the shelf 134. The further member 131 is formed in an opposite wall of the inner slot 116 to that of the projection 122. The further member 131 projects beyond the arcuate side 128 towards the projection 122. The further member 131 may be a tapered or angled leg. The further member 131 has a free end 133 that extends towards a plane that is in vertical alignment with a tip 122*a* of the projection 122, but which is located at a level lying below that tip 122*a*. During use, a projection-engaging feature on an underside of an article placed onto the product supporting surface 108 can be encouraged to extend into the inner slot 116 such that it will flex both around the projection 122, and against the further member 131, thus being held in place therein.

If the projection-engaging feature has an appropriately positioned hole, that hole can engage and lock onto the projection 122, or the further member 131.

In use, a projection-engaging feature of an article is inserted into the inner slot 116. The projection-engaging feature is configured such that it has an aperture which can be fitted over the projection 122 so as to "click" the connection-engaging feature in place. A diameter of the aperture in the projection-engaging feature may be the same, or, where an elastic material is used for the projection-engaging feature, slightly less than the diameter of the projection 122, so as to facilitate a tight fit.

In a variation of the attachment feature arrangement 112 shown in FIG. 1*c*, the further member 131 may be omitted. This may be particularly beneficial where there would otherwise be no access to the further member 131, specifically the free end 133 thereof, from an underside of the deck 106 (see FIG. 1*a*). For reference, the further member 131 shown in FIG. 1*c* is accessible from an underside of the deck 106. This is because the attachment feature arrangement 112 is one of the arrangements (see FIG. 1*a*) disposed along the long sides (corresponding with sidewalls 110*a*, 110*c*) of the deck 106. As also shown in FIG. 1*a*, the skids 104*a-c* do not interfere with, or obscure, the underside of the deck 106 in proximity to the attachment feature arrangement 112 (nor the other attachment feature arrangement disposed along that sidewall 110*a*). Hence, the further member 131 is accessible from an underside of the deck 106. This is in contrast to the attachment feature arrangements disposed at the short ends of the deck 106 (corresponding with sidewalls 110*b*, 110*d*), for which the corresponding further members, if present, would be obscured by the blocks 111.

The accessibility of the further member 131 from underneath the deck 106 is of particular significance when, for example, an adapter (not shown) is connected to the deck 106 using the further member 131. In such instances, it may be necessary to unhook, or release, a part of the adapter by flexing it over the further member 131. Access to the further member 131 from underneath the deck 106 may be necessary in order to facilitate the disconnection, or connection, of such an adapter. Where such access is not available, it may be advantageous to omit the further member 131 in its entirety from the attachment feature arrangement in question.

Despite the above, it will be appreciated that all of the attachment feature arrangements may otherwise share the same geometry. The attachment feature arrangements may all incorporate a respective further member.

FIG. 1*c* also shows two legs 135*a*, 135*b* which extend from the underside of the shelf 130. The legs 135*a*, 135*b* project across the inner slot 116 and engage the wall 119 which forms part of the divider 118. The legs 135*a*, 135*b* are L-shaped, as better shown in FIG. 1*d*. The legs 135*a*, 135*b* provide a buffer functionality in that any projection-engaging feature, such as a tab, which is removed from an article when the article is detached from the platform will be "caught" by the legs 135*a*, 135*b*. That is to say, if the legs 135*a*, 135*b* were not present, detached projection-engaging features may fall through the platform. Instead, these features are retained, or caught, by the legs 135*a*, 135*b* for easy disposal.

FIG. 1*d* is a perspective cutaway view of the portion of the platform 102 shown in FIG. 1*c*, taken about the section line 137 as indicated in FIG. 1*c*.

A top 122*b* of the projection 122 is shown to be in general alignment with the recessed shelf 130. The shelf 130 has a thickness below it, which thickness is integral with the further member 131 and it is arranged such that the further member 131 extends perpendicular to a leading edge 132 of the shelf—towards, yet downwards relative to, the projection 122. As shown, the leading edge 132 forms part of the arcuate side 128 and is therefore curved, so as to define a curved shape of the inner slot 116 to facilitate clicking a projection-engaging feature into place.

One of the L-shaped legs 135*a* is also shown extending from an underside of the shelf 130, across the inner slot 116 and (although not shown in FIG. 1*d*) engaging the wall 119.

The inner slot 116 of the illustrated embodiment is recessed relative to the product supporting surface 108, but in other embodiments may be flush with the product supporting surface 108. Similarly, although the illustrated projection 122 is recessed relative to the product supporting surface 108, in other embodiments the projection 122 may be flush with the product supporting surface 122.

Although a particular shape of inner slot 116 is illustrated, any other shape of slot may be used. For example, the slot may be curved or non-rectangular. Similarly, although a particular shape of projection 122 is illustrated, the projection may have any shape suitable for being received in an aperture of a projection-engaging feature.

In FIG. 1*d* both the leading edge 132 of the inner slot 116 and the rib 129*a* are chamfered. This is to guide projection-engaging features towards, and into, the inner slot 116.

FIG. 1*d* indicates how upper surfaces of both the outwardly-facing projections 120*a-c* and the projection 122 generally align with the lower width 127 of the recess 117. Furthermore, both sets of projections generally extend away from the wall 119, by an extent which increases moving towards an underside of the deck 106. Advantageously the recess 117 therefore guides a projection-engaging feature towards either set of projections, reducing the risk that the projection-engaging feature fouls on the wall 119. Instead, the projection-engaging feature is smoothly guided over a narrow, or thin, end of either the outwardly-facing projections 120*a-c* or the inwardly-facing projection 122, until such an extent that a hole, or aperture, therein is fully engaged by the projection(s). This may occur when the hole, or aperture, passes over a lowermost surface, or underside, of the projection(s).

Figure 2:
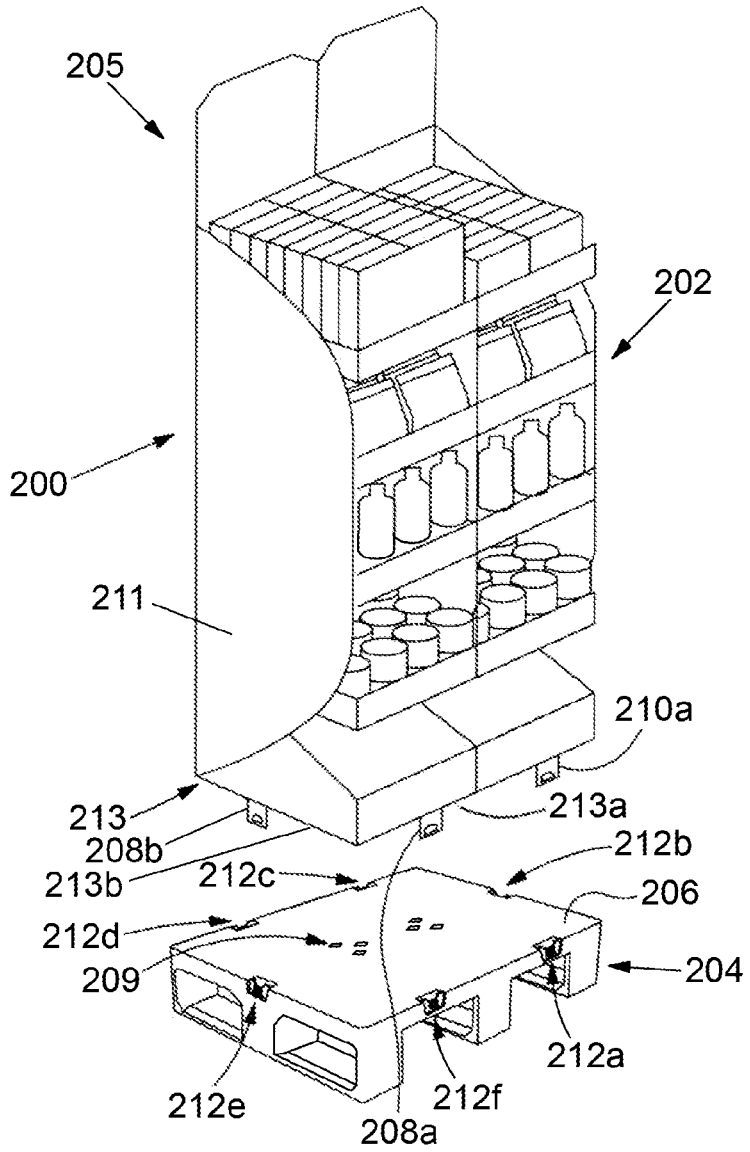
FIG. 2 is an exploded view of two quarter size displays on a half pallet according to another embodiment of the invention.
Figure 3:
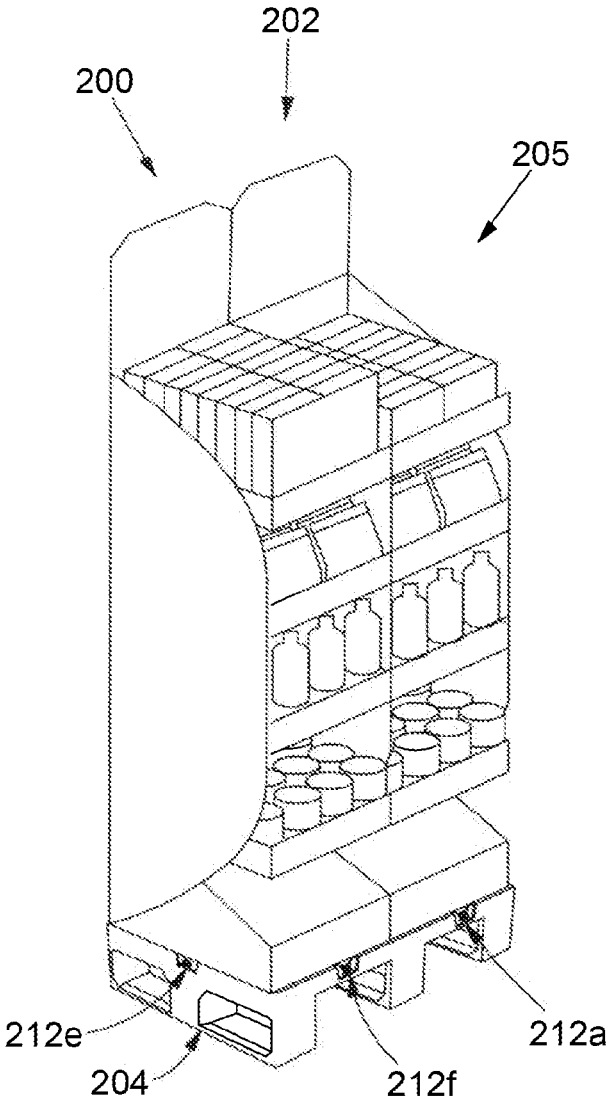
FIG. 3 is a perspective view of a pallet display assembly comprising two quarter size displays on a half pallet.

Turning to FIGS. 2 and 3, a further aspect of the invention (i.e. the second concept) relates to the use of two quarter size displays 200, 202 on a single half pallet 204. The half pallet 204 may comprise a platform and skids, as described in connection with the pallet 100 shown in FIGS. 1*a-d*.

FIG. 2 is an exploded view of a pallet display assembly 205, and FIG. 3 is a perspective view of the pallet display assembly 205.

As shown in the Figures, the quarter size displays 200, 202 are disposed on a product supporting surface 206 of the half pallet 204. Each quarter size display 200, 202 also comprises a plurality of projection-engaging features which are in the form of tabs 208*a*, 208*b*, 210*a*, 210*b* (not visible in FIG. 2). Each of the plurality of tabs 208*a*, 208*b*, 210*a* is received by a corresponding attachment feature 212*a-f* of the half pallet 204. The attachment features 212*a-f* may be the same as the attachment feature 112 described in connection with the first concept (and shown in detail in FIGS. 1*b*-1*d*). The specific features of the attachment features are described in detail in connection with FIGS. 1*b*-1*d*.

The tabs 208*a*, 210*a* aligned with a long side of the half pallet 204 are received by inner slots of the attachment features 212*a*, 212*f*. The tabs 208*a*, 210*a* are then engaged by a projection which forms part of the inner slots. More specifically, apertures in the tabs 208*a*, 210*a* are engaged by the projection (e.g. projection 122 in FIG. 1*c*). The tab 208*b*, aligned with a short side of half pallet 204, is received by an inner slot of the attachment feature 212*e* in the same manner as explained above.

In the illustrated pallet display assembly 205, the quarter size displays 200, 202 are the same. However, in other embodiments, two different quarter size displays may be used. The illustrated quarter size displays 200, 202 schematically depict a shelving arrangement, with goods or products supported by the shelving arrangement. However, it will be appreciated that other displays, or varieties or display, may otherwise be used.

As shown in FIG. 2, the quarter size display 200 comprises a structure 211. The structure 211 is, in the illustrated embodiment, a shelving arrangement. The structure 211 comprises a base 213 configured to engage the product supporting surface of the pallet 204. The base 213 is defined by four sides: two long sides (one of which is shown in FIG. 2, and labeled 213*b*) and two short sides (one of which is shown in FIG. 2, and labeled 213*a*). The tabs 208*a*, 208*b* extend from the base 213. Specifically, the tabs 208*a*, 208*b* extend from midpoints of the sides of the base 213.

The use of two quarter size displays on a half pallet is advantageous because the two quarter size displays, a popular size of display used in retail, can be stored, transported and displayed by using the single half pallet platform. This provides efficiency savings by way of reduced costs.

Where quarter size displays are used on a half pallet, three of the attachment feature arrangements described above may be used along three of four sides of the display. The final side of the display, specifically a projection-engaging feature (e.g. a tab) thereof, may pass through the product supporting surface 206 by using a diamond cut-out in the product supporting surface. The diamond cut-out may form part of an array 209 as illustrated in FIG. 2. In preferred arrangements it is an innermost diamond cut-out of the array 209 (i.e. that closest to a centreline of the half pallet 204) which is used to secure a respective display to that side of the half pallet 204. Put another way, the two central cut-outs of the array 209 are preferably used to, at least in part, secure respective POS displays to the half pallet 204.

FIGS. 4*a* and 4*b* are perspective and plan views, respectively, of a quarter pallet 300. The pallet 300 incorporates attachment feature arrangements as shown in FIGS. 1*a-d*.

The pallet 300 comprises a platform 302 which, in turn, comprises a deck 304. The pallet 300 further comprises four feet, two of which are visible in FIG. 4*a* and labeled 306*a*, 306*b*. The feet 306*a*, 306*b* are integrally formed with the platform 302 such that the pallet 300 is a single part, or body.

The deck 304 is defined by four sidewalls 308*a-d*. The pallet 300 further comprises four attachment feature arrangements 310*a-d*. The attachment feature arrangements

310*a-d* are the same as the attachment feature arrangement 112 described in connection with FIGS. 1 *a-d*. As such, the attachment feature arrangements 310*a-d* will not be described in detail.

Each one of the four attachment feature arrangements 310*a-d* is disposed along a respective one of the sidewalls 308*a-d*. As such, there is a single attachment feature arrangement 310*a-d* disposed along each sidewall 308*a-d*. Each of the attachment feature arrangements 310*a-d* are provided at a midpoint of each of the sidewalls 308*a-d*. That is to say, an attachment feature arrangement 310*a-d* is provided halfway along a length of the sidewalls 308*a-d*. Put another way, an attachment feature arrangement 310*a-d* is provided halfway along each edge of a product supporting surface 312 defined by the deck 306.

FIGS. 4*a* and 4*b* therefore illustrate a further pallet incorporating attachment feature arrangements.

Rectangular plan dimensions of platforms (commonly known as pallets) including but not limited to those that conform to ISO 6780:1003(E) have lengths and widths of 1200×800 mm (commonly known as Euro size), 1200×1000 mm (commonly known as full size), 1219×1016 mm or 1162×764 mm (AU size). Other standard sizes may be used in other regions of the world. The term "Half Pallet" is half of the size of the standard pallet according to the particular standard being used. Similarly, the term "Quarter Pallet" is a quarter of the size of the standard pallet according to the particular standard being used. For example, if the standard used in one region is 1200×800 mm, then a Half Pallet will have dimensions of 800×600 mm, and a Quarter Pallet will have dimensions of 600×400 mm. These standard dimensions are also applied to wheeled pallets commonly known as dollies, and also referred to as pallets on wheels or wheeled pallets.

A quarter size display refers to a display designed for use with a quarter size pallet, or platform. For example, a Euro size quarter size display may be designed for use with a quarter pallet deck having dimensions 600 mm×400 mm.

Pallets may be manufactured from plastic, or from some other material.

Throughout this document, an inward direction refers to a direction moving from a sidewall towards a central point of a product supporting surface (i.e. towards a centre of the product supporting surface, across the product supporting surface). Outward refers to a direction moving from the central point of the product supporting surface towards the sidewall (i.e. away from a centre of the product supporting surface, across the product supporting surface).

Where a projection-engaging feature is configured to engage an inwardly-facing projection, the projection-engaging feature may extend from a region of the base which is slightly offset from an edge of the base. That is to say, the projection-engaging feature may not extend from an outermost edge of the base and may instead extend from an inwardly recessed region of the base. This may be to facilitate the alignment of the projection-engaging feature with the inner slot.

The described and illustrated embodiments are to be considered as illustrative and not restrictive in character, it being understood that only preferred embodiments have been shown and described and that all changes and modifications that come within the scope of the inventions as defined in the claims are desired to be protected.

In relation to the claims, it is intended that when words such as "a," "an," "at least one," or "at least one portion" are used to preface a feature there is no intention to limit the claim to only one such feature unless specifically stated to the contrary in the claim.

When the language "at least a portion" and/or "a portion" is used the item can include a portion and/or the entire item unless specifically stated to the contrary.

Optional and/or preferred features as set out herein may be used either individually or in combination with each other where appropriate and particularly in the combinations as set out in the accompanying claims. The optional and/or preferred features for each aspect of the invention, or concept, set out herein are also applicable to any other aspects of the invention, where appropriate.

The invention claimed is:

1. A platform comprising;

a deck comprising:

a product supporting surface for supporting an article thereon, the deck being defined by a plurality of sidewalls which extend from a periphery of the product supporting surface, and at least one attachment feature arrangement disposed along one or more of the sidewalls, the at least one attachment feature arrangement comprising an inner slot and an outer recess, the inner slot and the outer recess being disposed adjacent one another and separated by a divider, the inner slot comprises one or more inwardly-facing projections, and the outer recess comprises one or more outwardly-facing projections, with the projections extending from the divider and configured to engage a corresponding projection-engaging feature of the article supported by the product supporting surface.

2. The platform according to claim 1, wherein the at least one attachment feature arrangement is disposed at a midpoint of the sidewall.

3. The platform according to claim 1, wherein the at least one attachment feature arrangement comprises a plurality of attachment feature arrangements, with at least one attachment feature arrangement being disposed along each of four sidewalls of the deck.

4. The platform according to claim 1, wherein the deck is generally rectangular such that two sidewalls are short sidewalls and two sidewalls are long sidewalls.

5. The platform according to claim 4, wherein at least one attachment feature arrangement comprises a plurality of respective attachment feature arrangements disposed along each of the two sidewalls, and a plurality of respective attachment feature arrangements disposed along each of the two short sidewalls.

6. The platform according to claim 5, wherein the plurality of respective attachment feature arrangements disposed along each of the two long sidewalls comprises two attachment feature arrangements, and wherein the two attachment feature arrangements are provided at positions around 25% and around 75% of a length of the two sidewalls respectively.

7. The platform according to claim 1, wherein the divider comprises a wall with a recess.

8. The platform according to claim 7, wherein the recess defines a plurality of portions of the wall which lie in the plane of the product supporting surface.

9. The platform according to claim 1, wherein the platform is a half pallet platform.

10. A pallet comprising:

a platform comprising a deck, the deck comprising:

a product supporting surface for supporting an article thereon, the deck being defined by a plurality of sidewalls which extend from a periphery of the product supporting surface, and at least one attachment feature arrangement disposed along one or more of the sidewalls, the at least one attachment feature arrangement comprising an inner slot and an outer recess, the inner slot and the outer recess being disposed adjacent one another and separated by a divider, the inner slot comprises one or more inwardly-facing projections, and the outer recess comprises one or more outwardly-facing projections, with the projections extending from the divider and configured to engage a corresponding projection-engaging feature of the article supported by the product supporting surface; and one or more pallet supports connected to the platform.

11. A pallet according to claim 10, wherein the pallet is a quarter pallet.

12. A pallet according to claim 10, wherein the pallet is a sixth pallet.

13. A quarter size display for the pallet according to claim 10, the quarter size display comprising:

a structure for supporting products thereon, the structure comprising a base configured to engage the product supporting surface of the pallet; and a plurality of projection-engaging features which extend from the base, configured to each engage corresponding inwardly-facing one or more projections or corresponding outwardly-facing one or more projections of a respective attachment feature arrangement of the platform of the pallet, and wherein the plurality of projection-engaging features are disposed along midpoints of at least three sides of the base.

14. A pallet display assembly comprising:

a half pallet comprising a deck, the deck comprising a product supporting surface; and two quarter size displays connected to the deck, wherein:

the product supporting surface is for supporting the two quarter size displays, with the deck being defined by the plurality of sidewalls which extends from a periphery of the product supporting face, the deck further comprises at least one attachment feature arrangement disposed along one or more of the sidewalls, the at least one attachment feature arrangement comprising an inner slot and an outer recess, the inner slot and the outer recess being disposed adjacent one another and separated by a divider, and the inner slot comprises one or more inwardly-facing projections, and the outer recess comprises one or more outwardly-facing projections, with the projections extending from the divider and configured to engage a corresponding projection-engaging feature of the article supported by the product supporting surface.

15. The pallet display assembly according to claim 14, wherein the half pallet comprises of one or more attachment feature arrangements, and the quarter size displays comprise one or more projection-engaging features, and the one or more projection-engaging features engage a respective projection of the one or more attachment feature arrangements.

16. The pallet display assembly according to claim 14, wherein each quarter size display comprises:

a structure for supporting products thereon, the structure comprising a base configured to engage the product supporting surface of the half pallet; and a plurality of projection-engaging features which extend from the base, configured to engage corresponding outwardly-facing projections of the pallet, and wherein the plurality of projection-engaging features are disposed along midpoints of at least three sides of the base.

* * * * *